US011021291B1

(12) United States Patent
Paiji et al.

(10) Patent No.: US 11,021,291 B1
(45) Date of Patent: Jun. 1, 2021

(54) REFRACTING BOTTLE

(71) Applicant: One Home Brands, Inc., New York, NY (US)

(72) Inventors: Sarah Lee Paiji, New York, NY (US); Lucas Lerman Lappe, New York, NY (US); Arthur Kenzo Debaigue, San Francisco, CA (US)

(73) Assignee: One Home Brands, Inc., New York, NY (US)

( * ) Notice: Subject to any disclaimer, the term of this patent is extended or adjusted under 35 U.S.C. 154(b) by 0 days.

(21) Appl. No.: 16/796,449

(22) Filed: Feb. 20, 2020

Related U.S. Application Data

(60) Provisional application No. 62/808,252, filed on Feb. 20, 2019, provisional application No. 62/836,409, filed on Apr. 19, 2019.

(51) Int. Cl.
*B65D 1/02* (2006.01)

(52) U.S. Cl.
CPC ..... *B65D 1/0207* (2013.01); *B65D 1/0223* (2013.01)

(58) Field of Classification Search
CPC ..... B65D 1/0207; B65D 1/0223
USPC ..... 222/190, 464.1, 464.7; 220/600, 602, 220/623; 215/370
See application file for complete search history.

(56) References Cited

U.S. PATENT DOCUMENTS

| | | | | |
|---|---|---|---|---|
| 922,125 | A | 5/1909 | Friedrich | |
| 4,470,526 | A * | 9/1984 | Cha | B67D 1/0456 222/320 |
| 4,495,325 | A * | 1/1985 | DeBergalis | C08F 8/00 524/507 |
| D378,801 | S * | 4/1997 | Blanche | D9/521 |
| 5,723,189 | A | 3/1998 | Sudo | |
| 6,276,566 | B1 * | 8/2001 | Zaksenberg | A45D 34/00 222/78 |
| D596,950 | S * | 7/2009 | Nevins | D9/503 |
| D602,368 | S * | 10/2009 | Rica | D9/544 |
| 9,924,775 | B2 * | 3/2018 | Jung | B05B 11/3001 |
| D825,341 | S * | 8/2018 | Staab | D9/529 |
| 10,239,029 | B2 * | 3/2019 | Khayman | B01F 15/00519 |
| 2003/0129142 | A1 * | 7/2003 | Schroeder | B65D 83/205 424/47 |
| 2005/0236423 | A1 * | 10/2005 | VanGordon | B65D 23/14 222/78 |
| 2008/0034628 | A1 * | 2/2008 | Schnuckle | B65D 23/085 40/310 |

FOREIGN PATENT DOCUMENTS

| | | | |
|---|---|---|---|
| CA | 2841326 | A1 | 7/2015 |
| JP | 2005-118480 | * | 5/2005 |

OTHER PUBLICATIONS

International Search Report and Written Opinion dated Aug. 5, 2020 in International Application No. PCT/2020/019057.

* cited by examiner

*Primary Examiner* — Lien M Ngo
(74) *Attorney, Agent, or Firm* — McDermott Will & Emery LLP

(57) ABSTRACT

A bottle is provided. In one aspect, the bottle includes an outer wall. An inner wall is surrounded by the outer wall and is separated from the outer wall by a first distance. A curved base extends from the inner wall. The curved base includes a concave area centrally disposed with respect to the inner wall. The concave area is configured to receive a tablet.

20 Claims, 17 Drawing Sheets

REFRACTING BOTTLE

CROSS-REFERENCE TO RELATED APPLICATIONS

The present application claims the benefit of priority under 35 U.S.C. § 119 from U.S. Provisional Patent Application Ser. No. 62/808,252 entitled "REFRACTING BOTTLE," filed on Feb. 20, 2019, and U.S. Provisional Patent Application Ser. No. 62/836,409 entitled "REFRACTING BOTTLE," filed on Apr. 19, 2019, the disclosures of which are hereby incorporated by reference in their entirety for all purposes.

TECHNICAL FIELD

The present disclosure generally relates to bottles, and more specifically to bottles capable of refraction.

BACKGROUND

Bottles are generally known in the art. Conventional bottles are typically designed with certain consideration factors such as, for example, shelf placement and weight for shipping. Such conventional bottles, however, are more basic and utilitarian in nature.

Accordingly, there is an unmet need for an improved bottle. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

The present disclosure is directed to a bottle that is capable of refraction. In certain aspects, the bottle is designed to receive effervescent tablets. In certain aspects, the bottle includes an inner wall with a curved base that is configured to receive the effervescent tablet. The curved base is designed in such a way that a unique effect is produced when the effervescent tablet reacts with liquid contained in the bottle. In certain aspects, the curved base is contoured with a narrowing concave area to not only add effect to the effervescence, but to allow the tablet to more efficiently dissolve. This is accomplished by allowing the tablet to naturally center within the chamber (i.e., not get trapped outside of the concave area) and thus will dissolve more quickly and completely. In certain aspects, such as those illustrated in FIGS. 1-11, for example, the curved base receives the tube from the spray head in such a manner that liquid in the bottle collects at the curved base and, during operation of the spray head, the tube gathers more of the liquid in the bottle. The bottle also includes an outer wall that surrounds the inner wall. Both the outer wall and the inner wall are clear such that liquid contained within the inner wall is visible through the outer wall. In certain aspects, a thickness separates the inner wall from the outer wall. In certain aspects, the thickness is non-uniform. In certain aspects, the shape of the inner wall intersections with the curved base to allow fluid to circulate more turbulently near the curved base to again provide more efficient dissolution of the tablet.

The outer wall of the bottle includes an outer base that includes a pad. In certain aspects, the pad includes selective coloring. In such aspects, the selective coloring is not a straight forward pantone color. In such aspects, the selective coloring is designed to create a refraction effect with specific colors of liquid contained in the bottle. In certain aspects, the selective coloring includes pigments and/or paints that are cradle-to-cradle certified. In certain aspects, the bottle itself is also cradle-to-cradle certified. In certain aspects, the bottle includes a reverse draft angle such that the overall weight of the bottle is reduced.

In certain aspects, the bottle is designed to contain 20 ounces of liquid although other amounts of liquid are certainly within the scope of the disclosure. In certain aspects, the bottle is not more than 11 inches in height although other heights of the bottle are within the scope of the disclosure.

In certain aspects, the bottle is lightweight. In certain aspects, the bottle includes a reverse draft angle as illustrated, for example, in FIGS. 1-11. In certain aspects, the bottle is formed of acrylic or other similar materials well known in the industry.

In certain aspects, as illustrated in FIGS. 1-11, the spray head includes an off-gassing inner nozzle mechanism. In certain aspects, as illustrated in FIGS. 12-22, the dispenser head includes an off-gassing inner nozzle mechanism.

In certain aspects, the bottom of the bottle is injection molded to achieve a thicker bottom in comparison to the rest of the bottle.

In certain aspects, the spray head includes an off-gassing nozzle mechanism that includes a water tight gasket, such that air may pass through, but liquid contained within the bottle does not escape.

In certain aspects, the bottle is manufactured with environmentally friendly certified materials.

In certain aspects, the bottle is designed to accept one or more effervescent tablets up to 7 grams/tablet. The tablets may be dropped in to the bottle through a bottleneck having an opening diameter of at least about 21.5 mm or about 21.5 mm to about 28 mm.

According to certain aspects of the present disclosure, a bottle is provided. The bottle includes an outer wall. An inner wall is surrounded by the outer wall and is separated from the outer wall by a first distance. A curved base extends from the inner wall. The curved base includes a concave area centrally disposed with respect to the inner wall. The concave area is configured to receive a tablet.

According to certain aspects of the present disclosure, a bottle is provided. The bottle includes an outer wall extending between an outer neck and an outer base. An inner wall is surrounded by the outer wall. The inner wall is separated from the outer wall by a first distance. A bottleneck is formed of the outer neck and an inner neck extending from the inner wall. The bottleneck terminates at an opening. A curved base extends from the inner wall. The curved base includes a concave area centrally disposed with respect to the inner wall and centrally aligned with the opening of the bottleneck. The concave area is configured to receive a tablet. The curved base is separated from the outer base by a second distance. The first distance gradually increases as the inner wall transitions towards the curved base such that the inner wall narrows transitionally towards the curved base.

According to certain aspects of the present disclosure, a bottle is provided. The bottle includes an outer wall extending between an outer neck and an outer base. An inner wall is surrounded by the outer wall. The inner wall is separated from the outer wall by a first distance. A bottleneck is formed of the outer neck and an inner neck extending from the inner wall. The bottleneck terminates at an opening. A curved base extends from the inner wall. The curved base includes a concave area centrally disposed with respect to the inner wall and centrally aligned with the opening of the bottleneck. A spray head removably coupled to the bottleneck. The concave area is configured to receive a tablet. The curved base is separated from the outer base by a second distance. The first distance gradually increases as the inner wall transitions towards the curved base such that the inner wall narrows transitionally towards the curved base. A pad is disposed at the outer base. The pad includes a selective coloring refractable through the curved base, the inner wall, and the outer wall.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
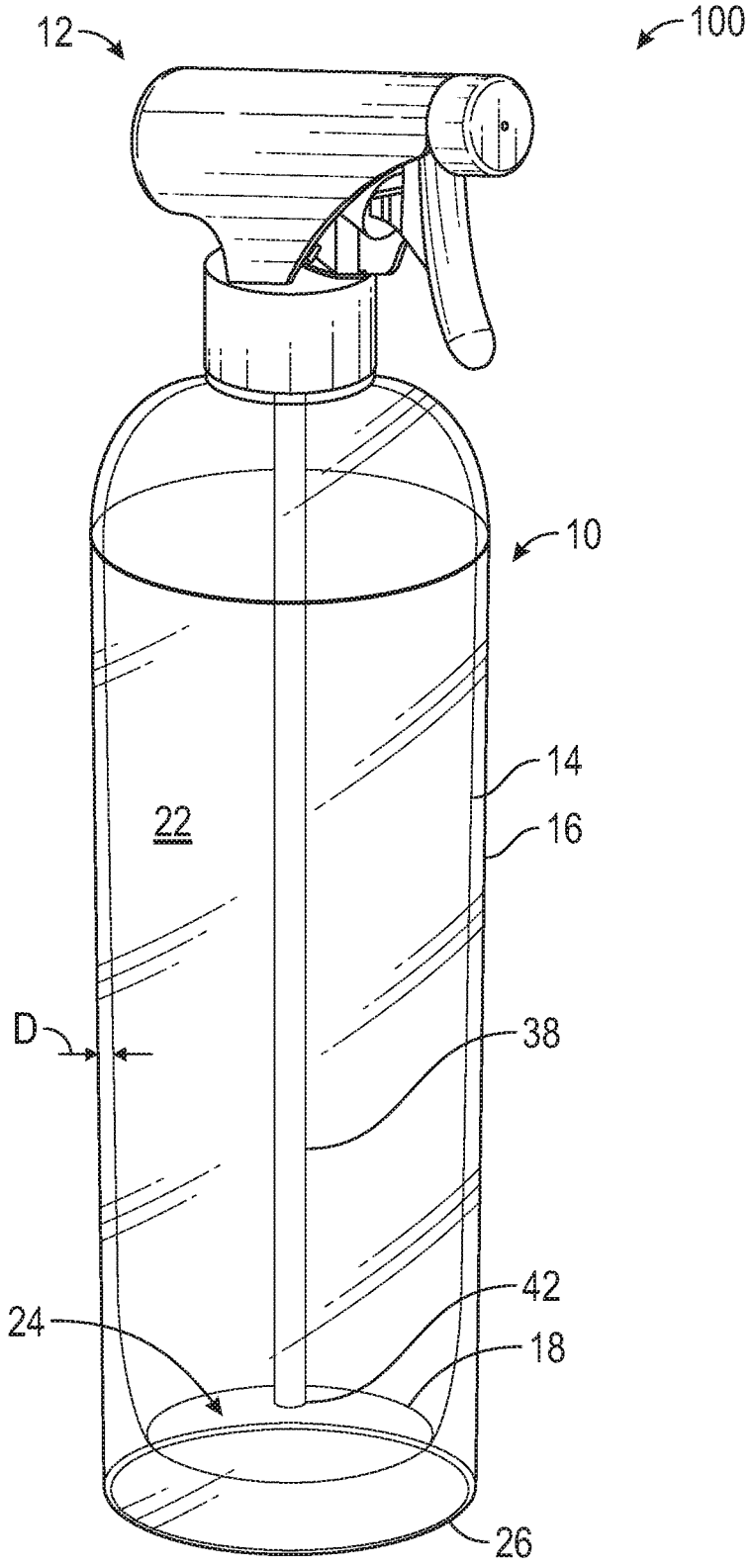
FIG. 1 illustrates a perspective view of a bottle according to certain aspects of the disclosure.
Figure 2:
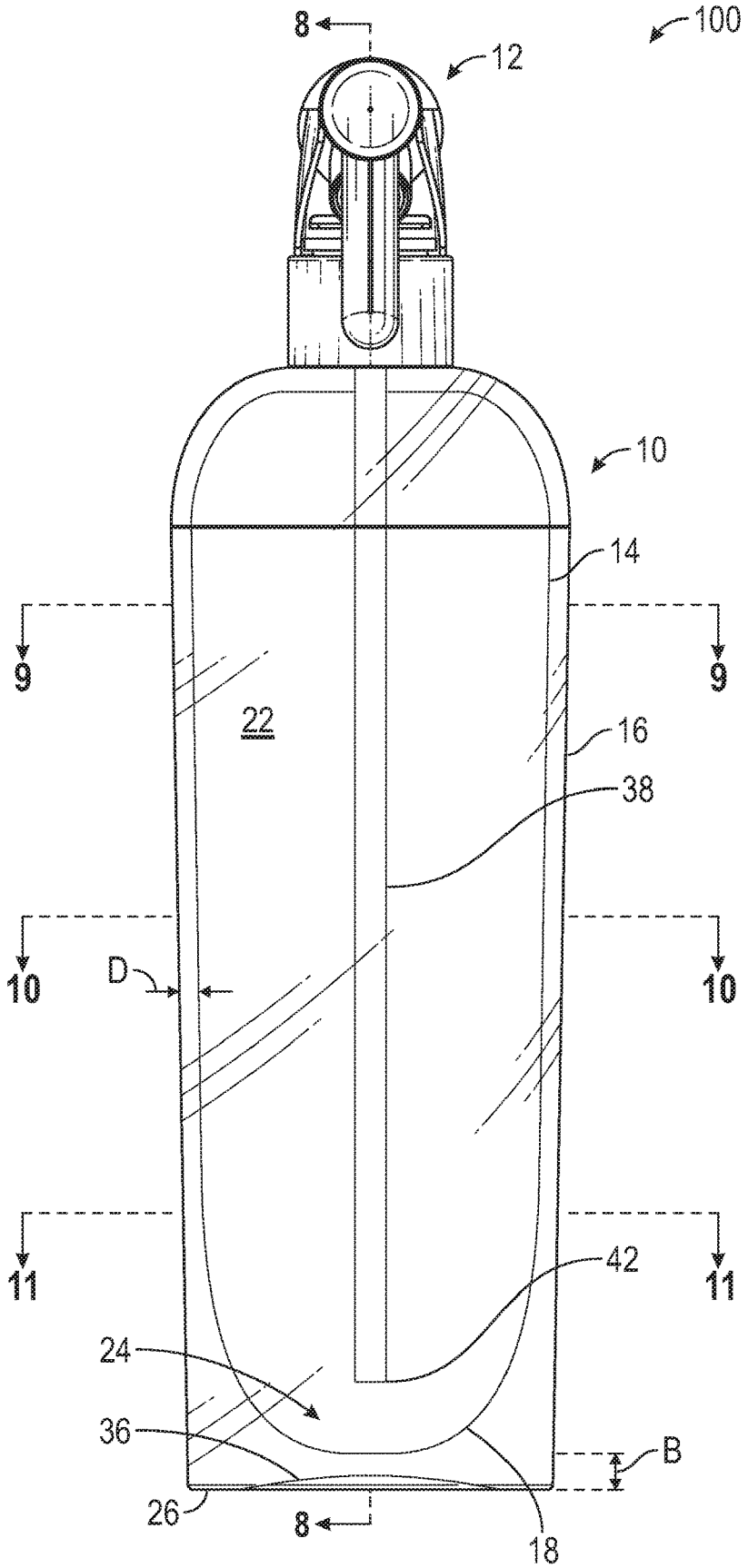
FIG. 2 illustrates a front view of the bottle of FIG. 1.
Figure 3:
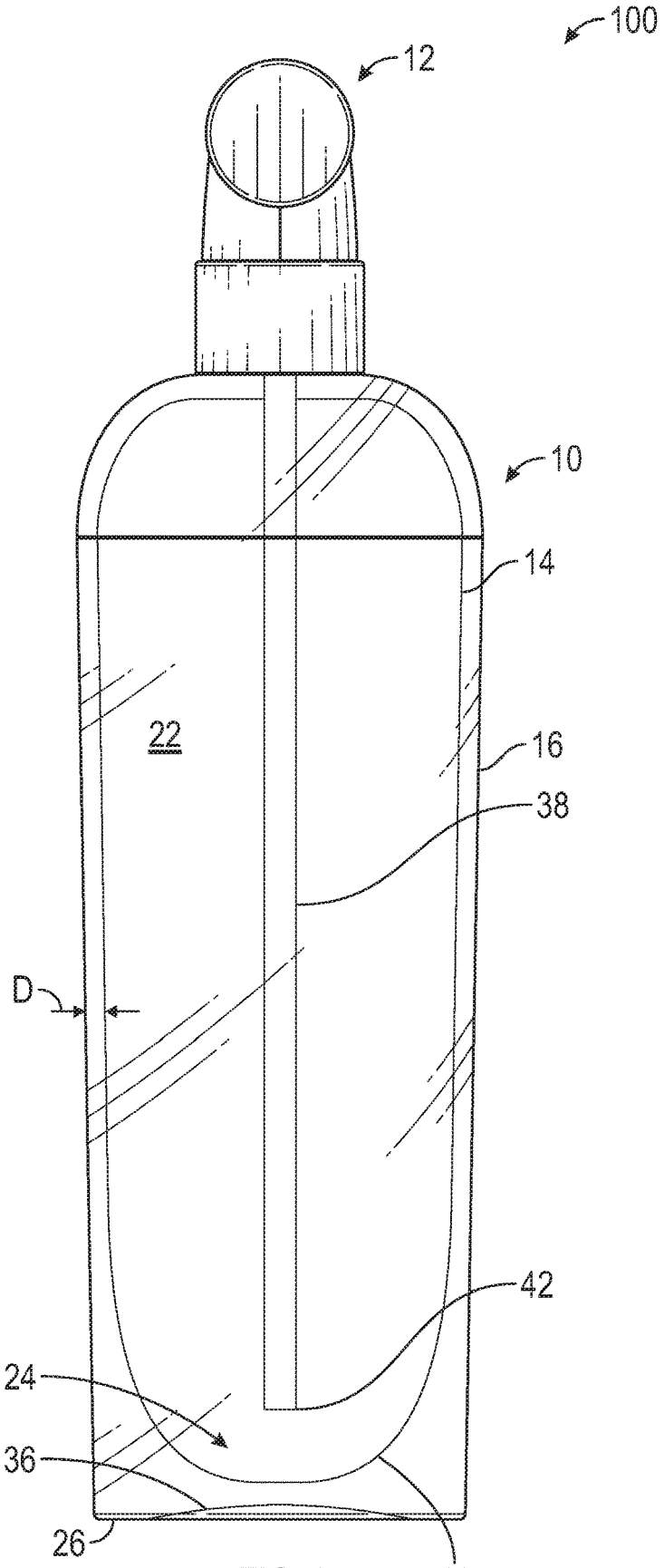
FIG. 3 illustrates a rear view of the bottle of FIG. 1.
Figure 4:
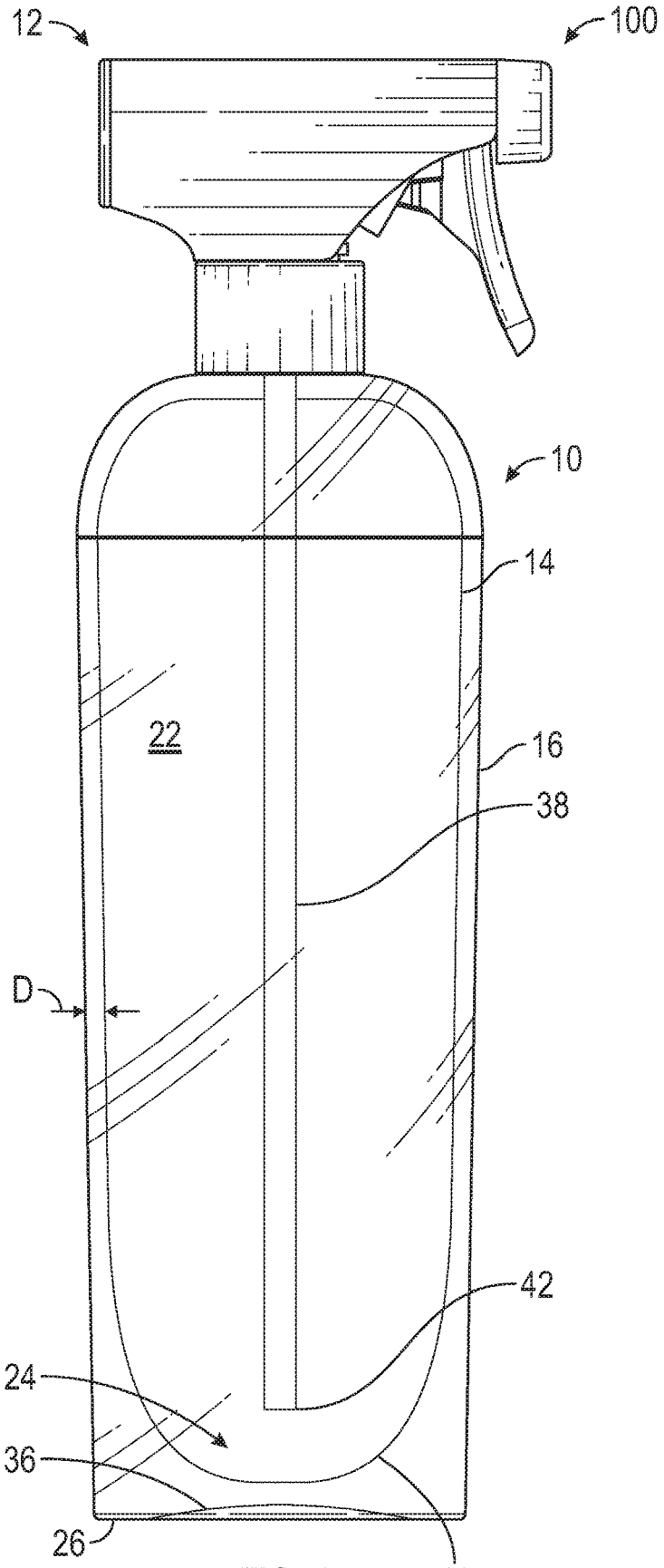
FIG. 4 illustrates a left side view of the bottle of FIG. 1.
Figure 5:
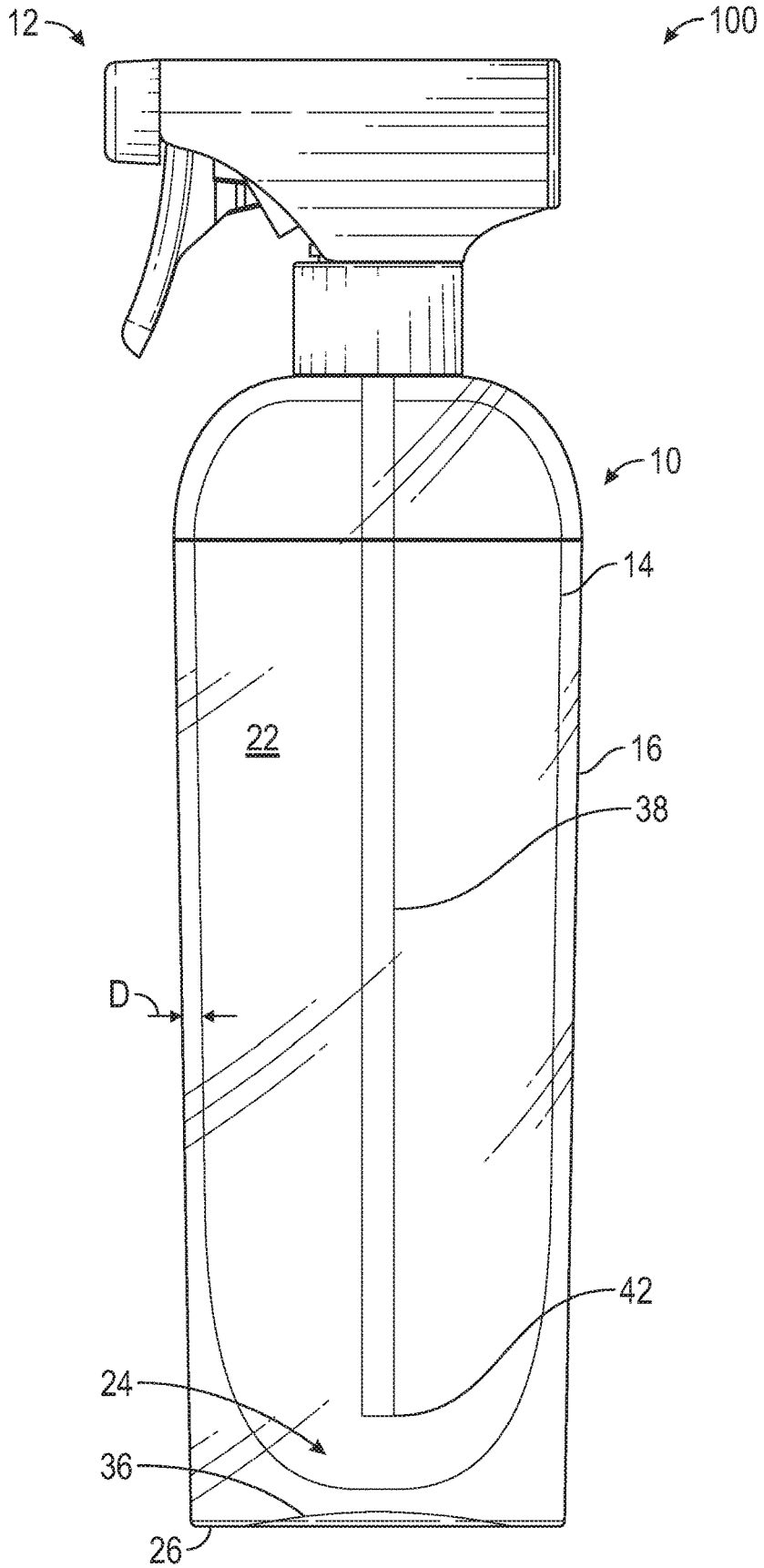
FIG. 5 illustrates a right side view of the bottle of FIG. 1.
Figure 6:
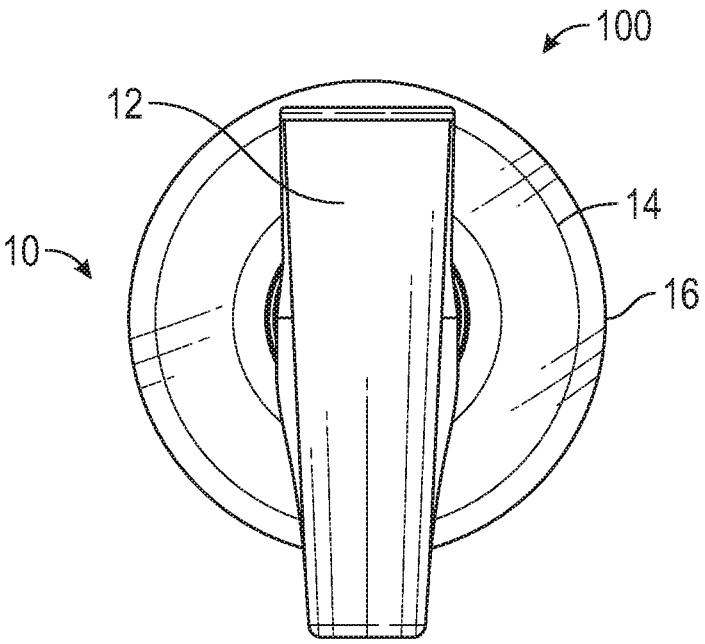
FIG. 6 illustrates a top plan view of the bottle of FIG. 1.
Figure 7:
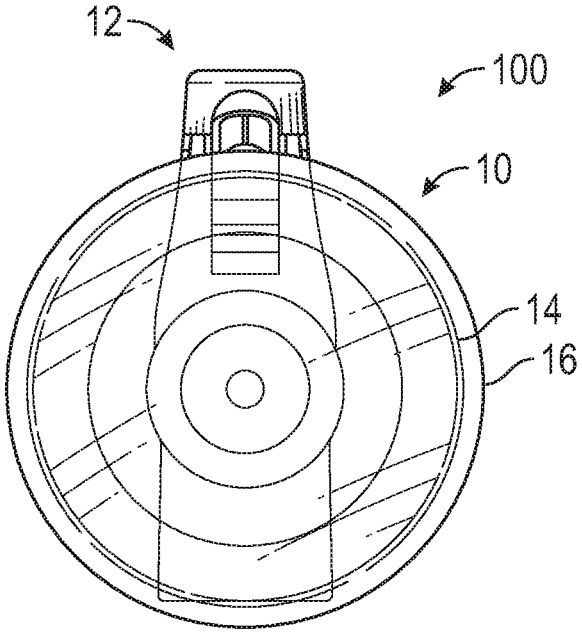
FIG. 7 illustrates a bottom plan view of the bottle of FIG. 1.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the refracting bottle discussed herein may be implemented in many different forms, the disclosure will show in the drawings, and will herein describe in detail, implementations with the understanding that the present description is to be considered as an exemplification of the principles of the refracting bottle and is not intended to limit the broad aspects of the disclosure to the implementations illustrated. Accordingly, the drawings and description are to be regarded as illustrative in nature and not restrictive.

Referring to FIGS. 1-11, an example bottle 100 is illustrated according to certain aspects of the disclosure. The bottle 100 is configured for refraction as will be described in more detail below. In certain aspects, the bottle 100 is a spray bottle, as exemplarily illustrated in FIGS. 1-11. The bottle 100 includes a body 10 and a spray head 12. The body 10 includes an inner wall 14 and an outer wall 16 surrounding the inner wall 14. The inner wall 14 transitions into a curved base 18. The curved base 18 extends from the inner wall 14. The inner wall 14 extends between the curved base 18 and an inner neck 20 (see FIG. 8) to collectively form a chamber 22 of the bottle 100. In certain aspects, the curved base 18 is contoured with a concave area 24. In certain aspects, the chamber 22 of the bottle 100 is configured to hold 20 ounces of fluid although other amounts are certainly within the scope of the disclosure.

The outer wall 16 transitions into an outer base 26. The outer wall 16 extends between the outer base 26 and an outer neck 28 (see FIG. 8) to collectively surround the inner wall 14, the curved base 18, and the inner neck 20 such that the outer wall 16 and the inner wall 14 are separated by a distance D. In certain aspects, the distance D is a variable distance. In other aspects, the distance D is a uniform distance. The outer base 26 and the curved base 18 are similarly separated by a distance B (see FIG. 2). In certain aspects, the distance B is greater than the distance D such that a bottom section of the bottle 100 is thicker than other portions of the bottle 100. In certain aspects, the distance D is equal to the distance B. In other aspects, the distance D is greater than the distance B. In certain aspects, the bottle 100 includes a reverse draft angle substantially proximate the curved base 18, such as, for example, where the distance D intersects the distance B. In such aspects, the reverse draft angle allows for reduction of the overall weight of the bottle 100.

The outer neck 28 and the inner neck 20 form a bottleneck 30 of the bottle 100 and terminate at an opening 32. The opening 32 of the bottleneck 30 is configured to receive one or more effervescent tablets (not shown). The effervescent tablet can be approximately 7 grams or less. In certain aspects, the opening 32 includes a diameter that is approximately at least 21.5 mm. In other aspects, the opening 32 includes a diameter that is approximately in the range of 21.5 mm to 28 mm. In certain aspects, a plurality of threads 34 are disposed on an exterior of the outer neck 28 and is configured to matingly engage with corresponding threads on the spray head 12 for removable coupling of the spray head 12 to the body 10 of the bottle 100.

While the distance D between the inner wall 14 and the outer wall 16 is substantially uniform along a majority length of the bottle 100, the distance D gradually increases as the inner wall 14 transitions into the curved base 18. The narrowing of the inner wall 14 as it transitions towards the curved base 18 forms the contour of the concave area 24. The concave area 24 is substantially centrally aligned with the opening 32 of the bottleneck 30. The concave area 24 of the curved base 18 is configured to receive the one or more effervescent tablets inserted into the opening 32 of the bottleneck 30. The concave area 24 of the curved base 18 is designed in such a manner that a unique effect is produced when the effervescent tablet reacts with fluid contained in the chamber 22 at the curved base 18. The narrowing of the inner wall 14 as it transitions towards the concave area 24 of the curved base 18 not only adds effect to the effervescence, but also allows the effervescent tablet to efficiently dissolve by centrally positioning the effervescent tablet within the bottle 100. For example, with the effervescent tablet inserted into the opening 32 of the bottleneck 30, the effervescent tablet passes through fluid in the chamber 22 and naturally center towards the concave area 24 of the curved base 18 such that it will dissolve quickly and completely. In certain aspects, the narrowing of the inner wall 14 as it transitions towards the concave area 24 of the curved base 18 provides a profile allowing fluid to circulate more turbulently during the effervescent reaction near the curved base 18 and, in turn, provide more efficient dissolution of the effervescent tablet.

The outer wall 16 and the inner wall 14 are both formed from clear material such that fluid contained in the chamber 22 is visible through both the inner wall 14 and the outer wall 16 of the bottle 100. In certain aspects, the inner wall 14 and the outer wall 16 are formed of, but not limited to, acrylic, polymer, non-polymer, glass, polycarbonate, Polyethylene terephthalate (PET), PTCG for example, or other similar well-known materials in the industry. In certain aspects, the body 10, and/or the bottle 100 itself, is manufactured with environmentally friendly certified materials. In such aspects, the body 10, and/or the bottle 100 itself, can be cradle-to-cradle certified. In certain aspects, the height of the bottle 100 is not more than 11 inches although other heights are within the scope of this disclosure.

Figure 8:
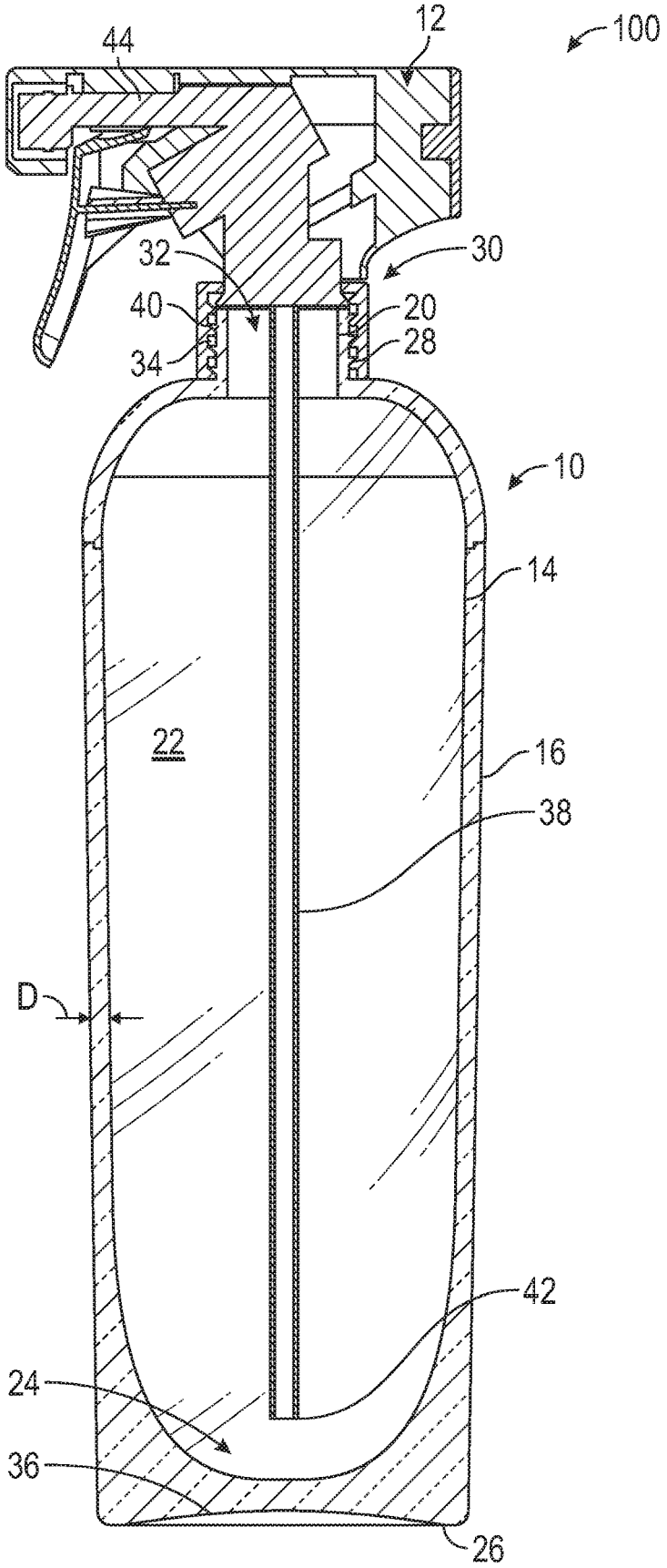
FIG. 8 illustrates a cross-sectional view taken long line 8-8 in FIG. 2.
Figure 9:
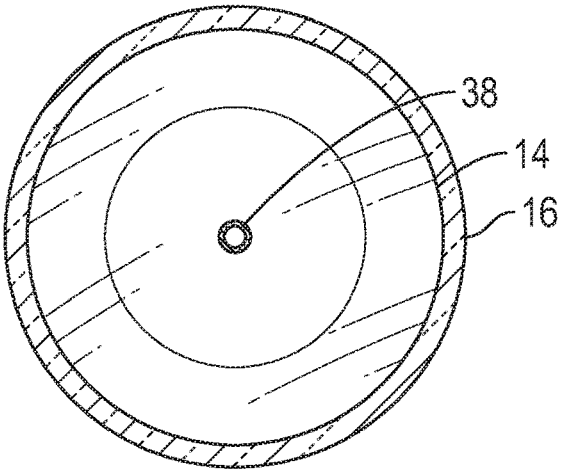
FIG. 9 illustrates a cross-sectional view taken long line 9-9 in FIG. 2.
Figure 10:
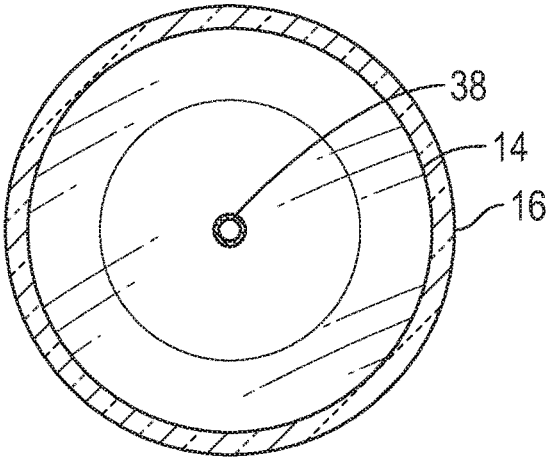
FIG. 10 illustrates a cross-sectional view taken long line 10-10 in FIG. 2.
Figure 11:
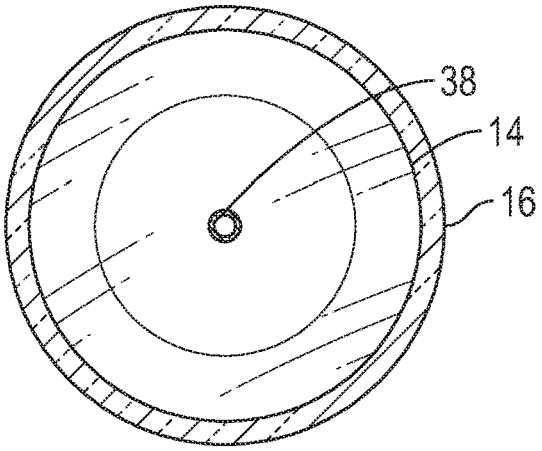
FIG. 11 illustrates a cross-sectional view taken long line 11-11 in FIG. 2.
Figure 12:
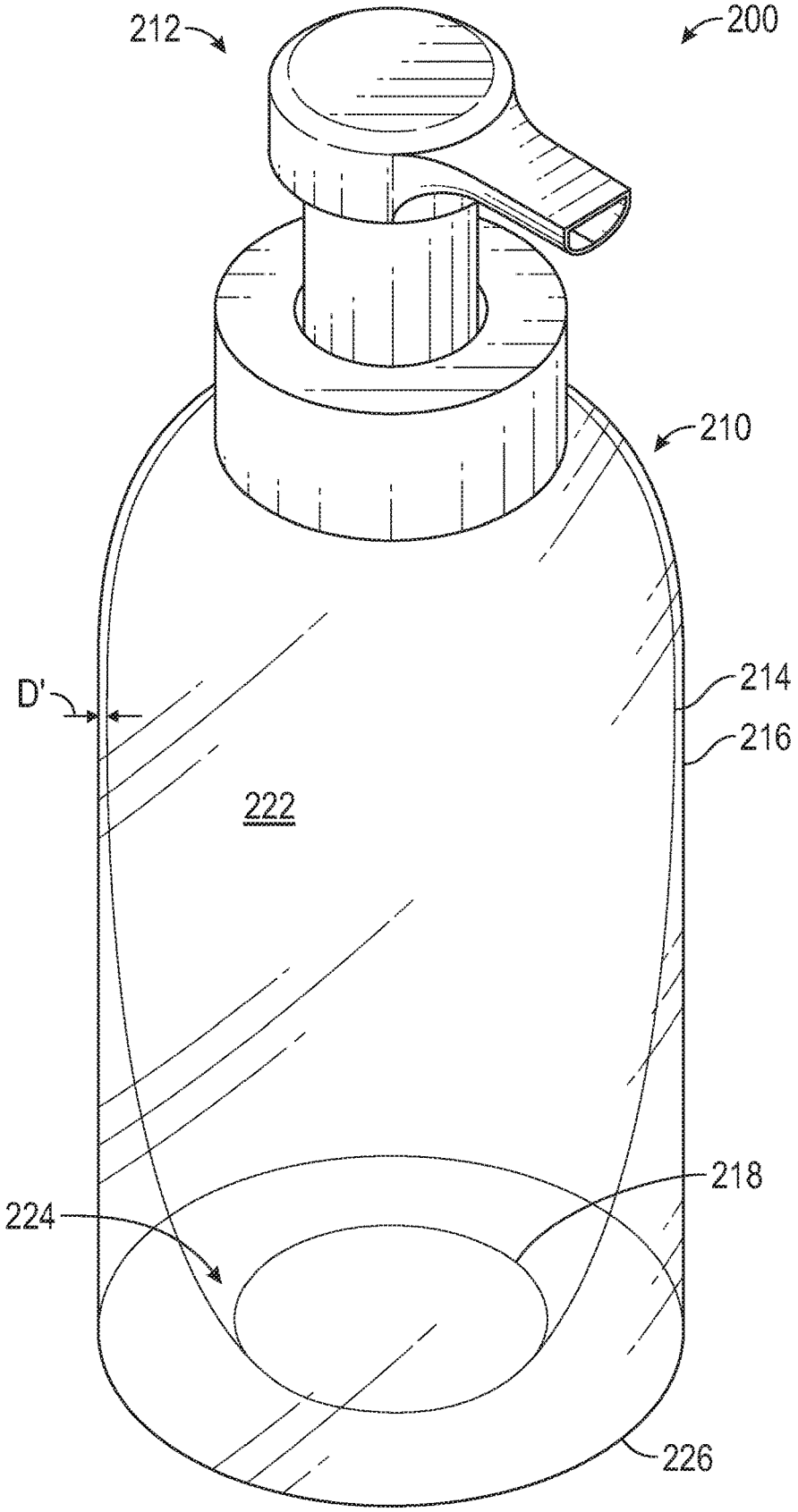
FIG. 12 illustrates a perspective view of a bottle according to certain alternative aspects of the disclosure.
Figure 13:
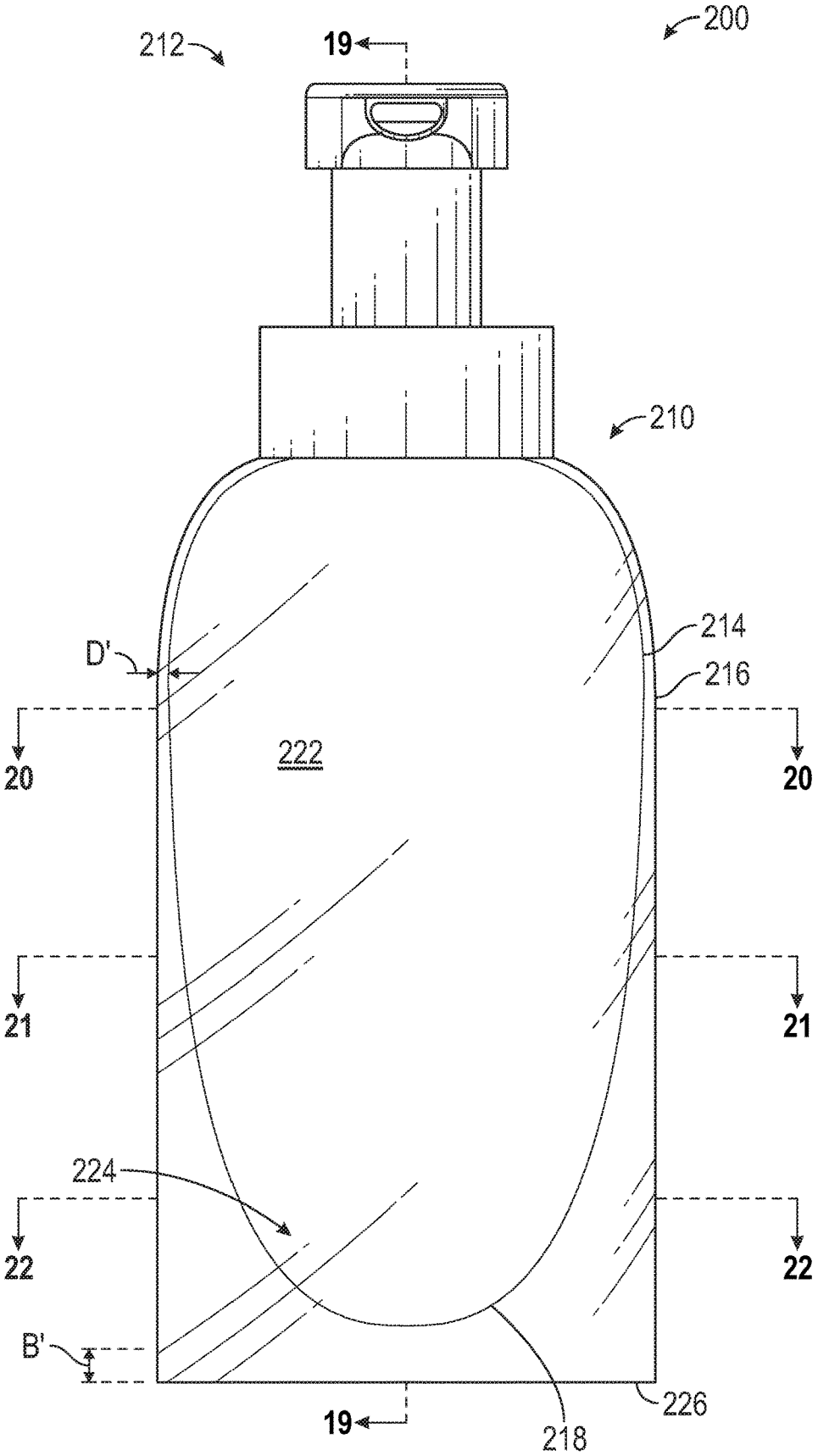
FIG. 13 illustrates a front view of the bottle of FIG. 12.
Figure 14:
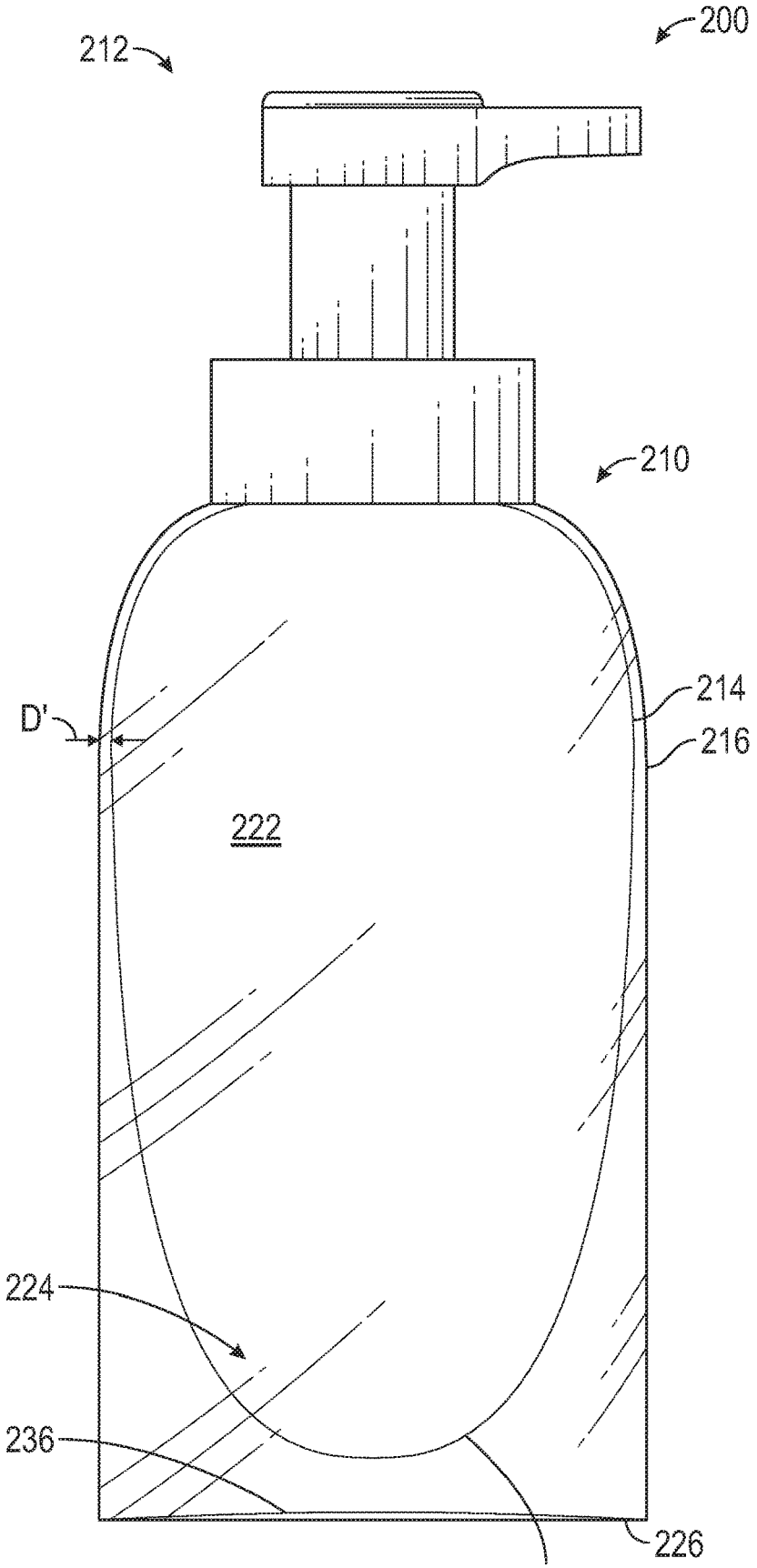
FIG. 14 illustrates a rear view of the bottle of FIG. 12.
Figure 15:
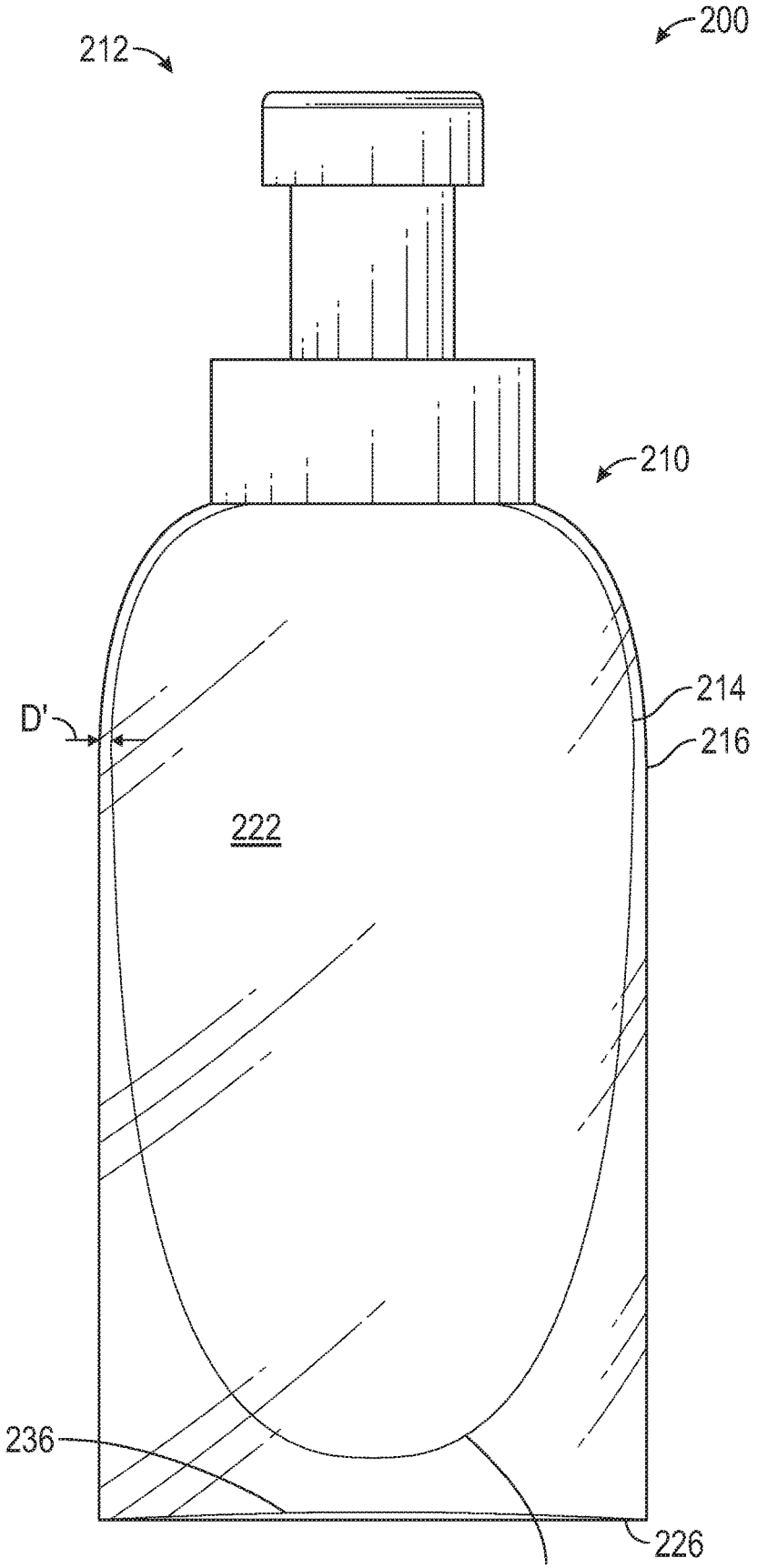
FIG. 15 illustrates a left side view of the bottle of FIG. 12.
Figure 16:
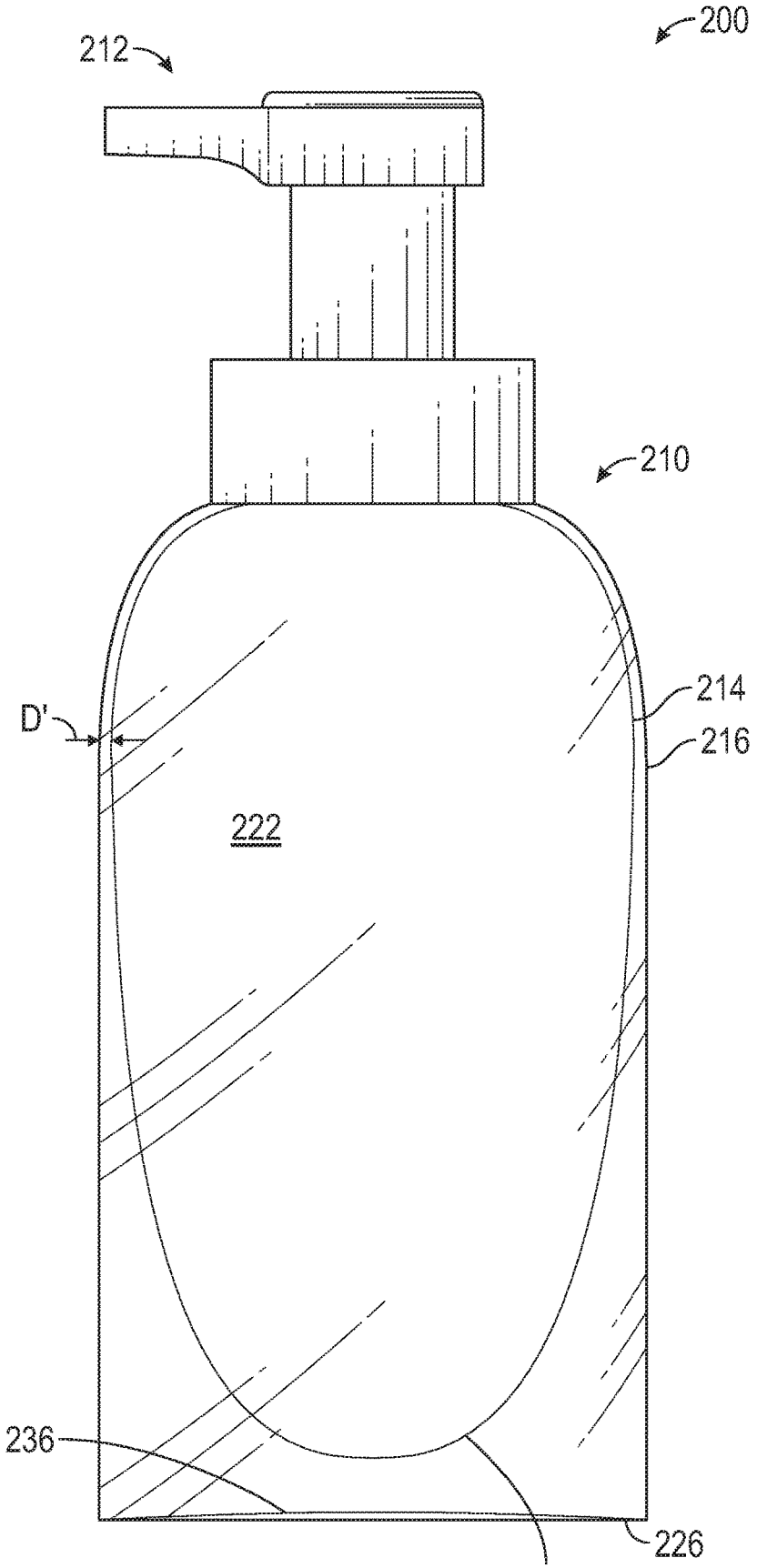
FIG. 16 illustrates a right side view of the bottle of FIG. 12.
Figure 17:
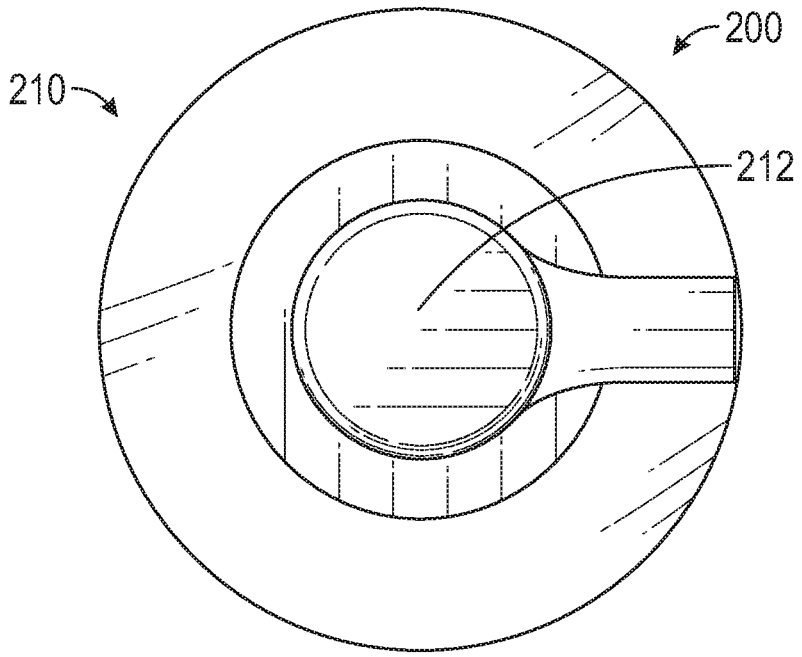
FIG. 17 illustrates a top plan view of the bottle of FIG. 12.
Figure 18:
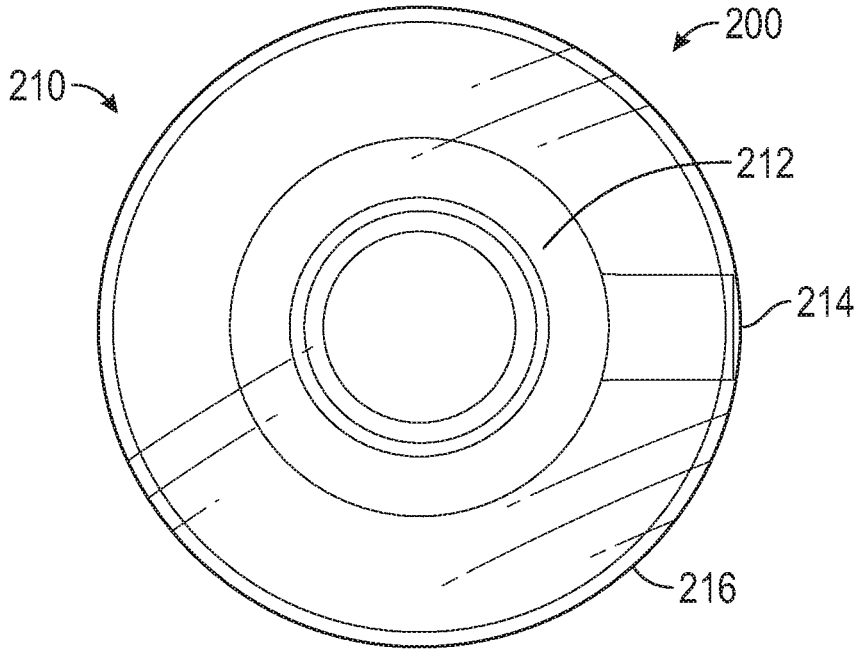
FIG. 18 illustrates a bottom plan view of the bottle of FIG. 12.

The outer base 26 includes a pad 36 (see FIG. 8). In certain aspects, the pad 36 includes selective coloring. The pad 36 can be, for example, but is not limited to, a physical pad, paint, a coating, and other such coloring features that are well known in the industry. In such aspects, the selective coloring is not a straight forward color selected from a commercially available palette, but is instead strategically designed to create a refraction effect with specific colors of liquid contained in the chamber 22 of the bottle 100. The selective coloring of the pad 36 of the outer base 26 is refractable through the curved base 18, the inner wall 14, and the outer wall 16. In certain aspects, the selective coloring includes pigments and/or paints that are cradle-to-cradle certified. In certain aspects, the pad 36 is injection molded with the outer base 26. It should be understood that the refraction effect is possible regardless of whether the distance D is variable or uniform.

The spray head 12 includes a tube 38 and a plurality of threads 40. The plurality of threads 40 (see FIG. 8) are configured to matingly engage with the plurality of threads 34 disposed on the outer neck 28 for removable coupling of the spray head 12 to the body 10 of the bottle 100. When the spray head 12 is removably coupled to the body 10 the tube 38 extends through the chamber 22 towards the curved base 18. In certain aspects, the tube 38 is disposed within the chamber 22 such that an end 42 of the tube 38 is separated from and not in contact with the curved base 18. In other aspects, the tube 38 is disposed within the chamber 22 such that the end 42 of the tube 38 contacts the curved base 18. In such aspects, with the fluid in the chamber 22 centrally collected or concentrated at the concave area 24 of the curved base 18, the tube 38 contacts the fluid at the concave area 24 of the curved base 18 and, during operation of the spray head 12, is configured to transfer more of the fluid in the bottle 100 via the spray head 12. In certain aspects, the spray head 12 includes an off-gassing nozzle 44 (see FIG. 8) including a water tight gasket (not shown). The off-gassing nozzle 44 is configured such that air may pass through, but fluid contained within the chamber 22 of the bottle 100 does not escape.

In operation, the spray head 12 is uncoupled from the bottleneck 30 to expose the opening 32. With fluid in the chamber 22 of the bottle 100, one or more effervescent tablets is inserted through the opening 32 of the bottleneck 30. The one or more effervescent tablets passes centrally through the fluid, with respect to the inner wall 14, towards the concave area 24 of the curved base 18. The one or more effervescent tablets settles at a substantially central portion of the curved base 18. The central positioning of the one or more effervescent tablets with respect to the curved base 18 and inner wall 14 allows the one or more effervescent tablets to dissolve efficiently and completely. The central positioning of the one or more effervescent tablets at the curved base 18 also allows the effervescence to evenly distribute along the inner wall 14 towards the bottleneck 30. Because both the inner wall 14 and the outer wall are clear, the effervescence is visible through the bottle 100. Additionally, the selective coloring of the pad 36 is specifically paired with the color of the fluid in the chamber 22 to create a refraction effect with the effervescence and the color of the fluid.

In an alternative implementation, the body 10 is formed of an upper portion and a lower portion such that the spray head 12 is permanently integrated to the upper portion. Further, the upper portion is removably couplable to the lower portion.

Referring to FIGS. 12-22, an alternative example bottle 200 is illustrated according to certain aspects of the disclosure. The bottle 200 is configured for refraction as will be described in more detail below. While the bottle 200 holds the same principles as those described above with respect to the bottle 100, the bottle 200 is a dispenser bottle instead of a spray bottle. The bottle 200 includes a body 210 and a dispenser head 212. The body 210 includes an inner wall 214 and an outer wall 216 surrounding the inner wall 214. The inner wall 214 transitions into a curved base 218. The curved base 218 extends from the inner wall 214. The inner wall 214 extends between the curved base 218 and an inner neck 220 (see FIG. 19) to collectively form a chamber 222 of the bottle 200. In certain aspects, the curved base 218 is contoured with a concave area 224. In certain aspects, the chamber 222 of the bottle 200 is configured to hold 20 ounces of fluid although other amounts are certainly within the scope of the disclosure.

The outer wall 216 transitions into an outer base 226. The outer wall 216 extends between the outer base 226 and an outer neck 228 (see FIG. 19) to collectively surround the inner wall 14, the curved base 226, and the inner neck 220 such that the outer wall 216 and the inner wall 214 are separated by a distance D'. In certain aspects, the distance D' is a variable distance. In other aspects, the distance D' is a uniform distance. The outer base 226 and the curved base 218 are similarly separated by a distance B' (see FIG. 13). In certain aspects, the distance B' is greater than the distance D' such that the bottom section of the bottle 200 is thicker than other portions of the bottle 200. In certain aspects, the distance D' is equal to the distance B'. In other aspects, the distance D' is greater than the distance B'. In certain aspects, the bottle 200 includes a reverse draft angle substantially proximate the curved base 218, such as, for example, where the distance D' intersects the distance B'. In such aspects, the reverse draft angle allows for reduction of the overall weight of the bottle 200.

The outer neck 228 and the inner neck 220 form a bottleneck 230 of the bottle 200 and terminate at an opening 232. The opening 232 of the bottleneck 230 is configured to receive one or more effervescent tablets (not shown). The effervescent tablet can be approximately 7 grams or less. In certain aspects, the opening 232 includes a diameter that is approximately at least 21.5 mm. In other aspects, the opening 232 include a diameter that is approximately in the range of 21.5 mm to 28 mm. In certain aspects, the bottleneck 230 is configured to operatively engage with the dispenser head 212 for removable coupling with the bottleneck 230 in sealing engagement.

While the distance D' between the inner wall 214 and the outer wall 216 is substantially uniform along portions of the length of the bottle 200, the distance D' gradually increases as the inner wall 214 transitions into the curved base 218. The narrowing of the inner wall 214 as it transitions towards the curved base 218 forms the contour of the concave area 224. The concave area 224 of the curved base 218 is configured to receive the one or more effervescent tablets inserted into the opening 232 of the bottleneck 230. The concave area 224 of the curved base is designed in such a manner that a unique effect is produced when the effervescent tablet reacts with the fluid contained in the chamber 222 at the curved base 218. The narrowing of the inner wall 214 as it transitions towards the concave area 224 of the curved base 218 not only adds effect to the effervescence, but also allows the effervescent tablet to efficiently dissolve by centrally positioning the effervescent tablet within the bottle 200. For example, with the effervescent tablet inserted into the opening 232 of the bottleneck 230, the effervescent tablet passes through the fluid in the chamber 222 and naturally center towards the concave area 224 of the curved base 218 such that it will dissolve quickly and completely. In certain aspects, the narrowing of the inner wall 214 as it transitions towards the concave area 224 of the curved base 218 provides a profile allowing fluid to circulate more turbulently during the effervescent reaction near the curved base 218 and, in turn, provide more efficient dissolution of the effervescent tablet.

The outer wall 216 and the inner wall 214 are both formed from clear material such that fluid contained in the chamber 222 is visible through both the inner wall 214 and the outer wall 216 of the bottle 200. In certain aspects, the inner wall 214 and the outer wall 216 are formed of, but not limited to, acrylic, polymer, non-polymer, glass, polycarbonate, Polyethylene terephthalate (PET), PTCG for example, or other similar well-known materials in the industry. In certain aspects, the body 210, and/or the bottle 200 itself, is manufactured with environmentally friendly certified materials. In such aspects, the body 210, and/or the bottle 200 itself, can be cradle-to-cradle certified. In certain aspects, the height of the bottle 200 is not more than 11 inches although other heights are within the scope of this disclosure.

Figure 19:
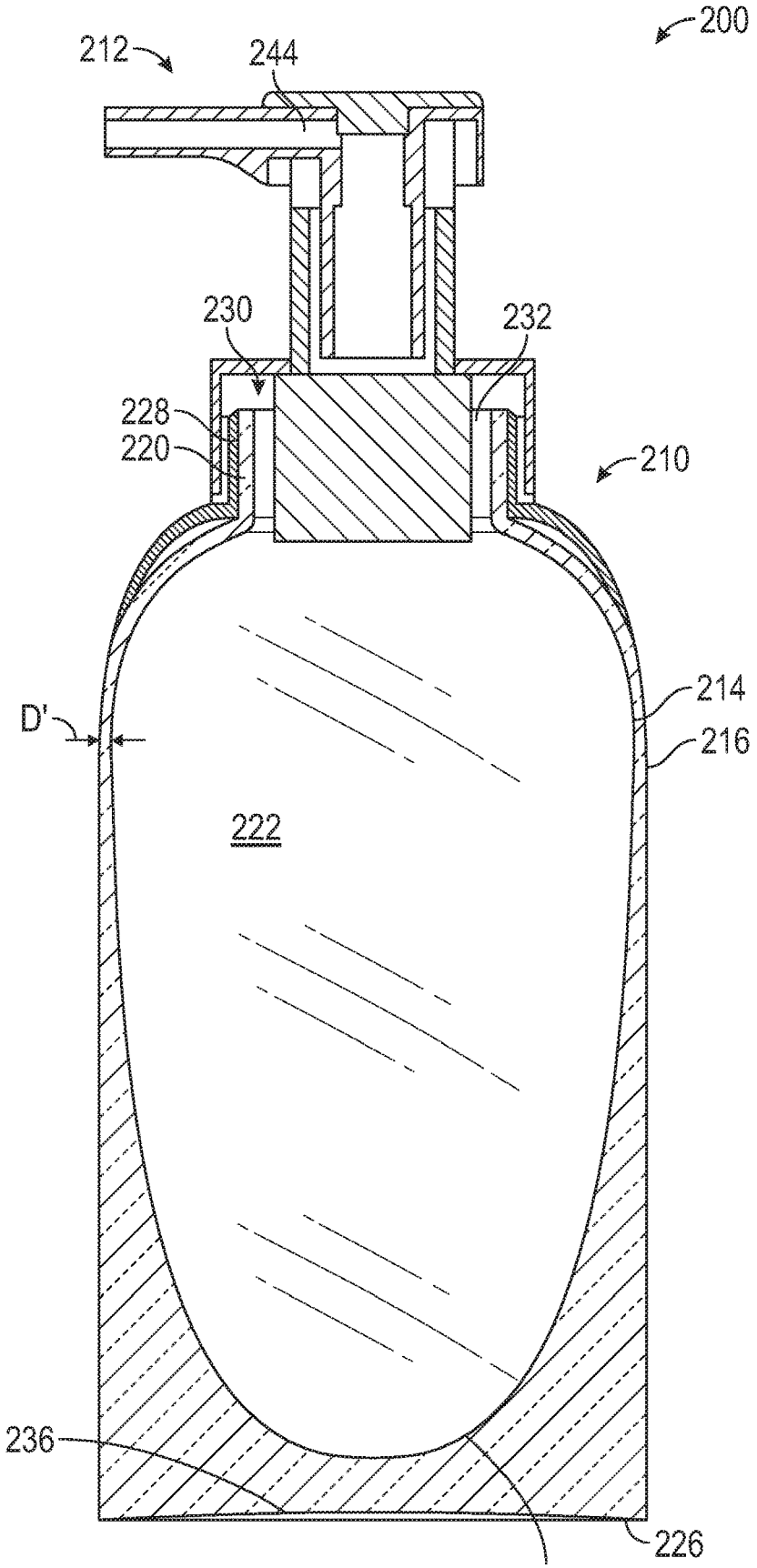
FIG. 19 illustrates a cross-sectional view taken long line 19-19 in FIG. 13.
Figure 20:
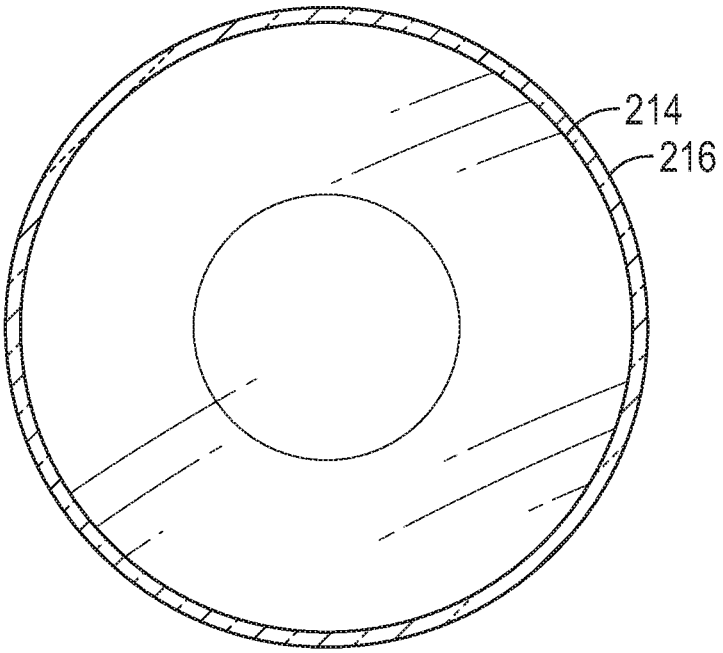
FIG. 20 illustrates a cross-sectional view taken long line 20-20 in FIG. 13.
Figure 21:
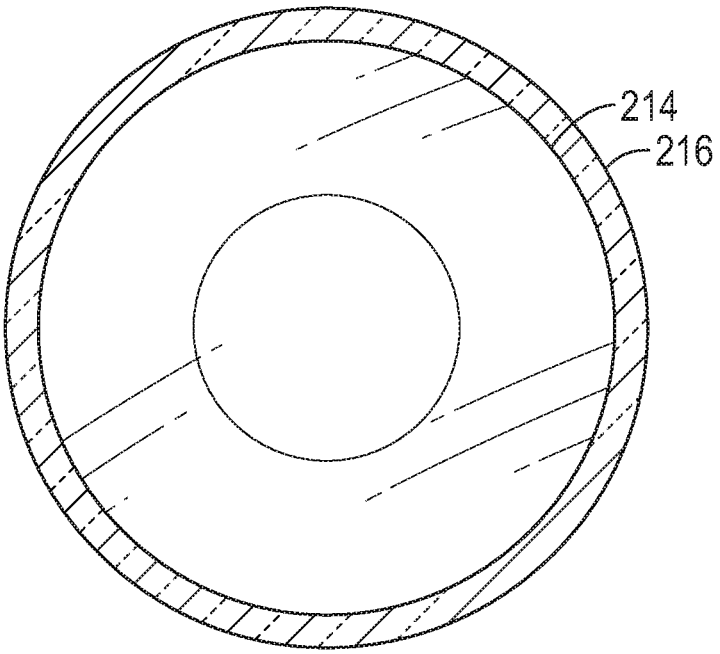
FIG. 21 illustrates a cross-sectional view taken long line 21-21 in FIG. 13.
Figure 22:
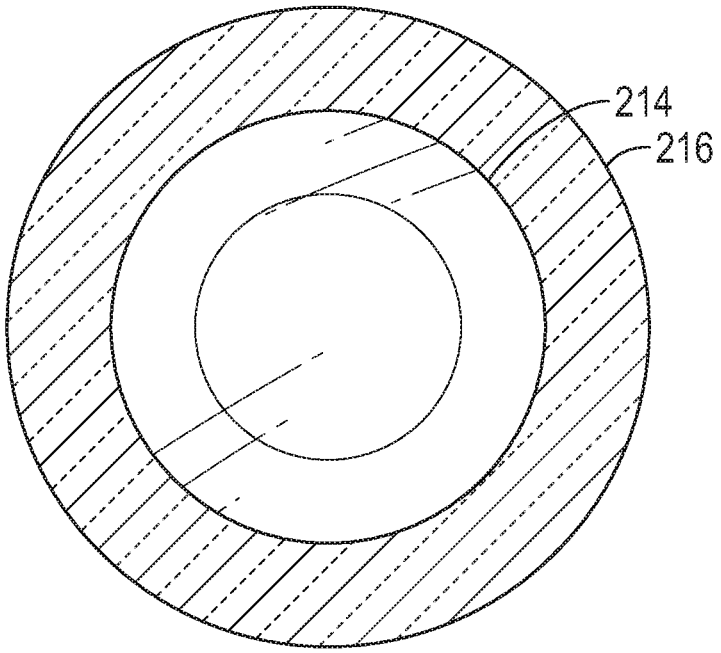
FIG. 22 illustrates a cross-sectional view taken long line 22-22 in FIG. 13.

The outer base 226 includes a pad 236 (see FIG. 19). In certain aspects, the pad 236 includes selective coloring. The pad 236 can be, for example, but is not limited to, a physical pad, paint, a coating, and other such coloring features that are well known in the industry. In such aspects, the selective coloring is not a straight forward color selected from a commercially available palette, but is instead strategically designed to create a refraction effect with specific colors of fluid contained in the chamber 222 of the bottle 200. The selective coloring of the pad 236 of the outer base 226 is refractable through the curved base 218, the inner wall 214, and the outer wall 216. In certain aspects, the selective coloring includes pigments and/or paints that are cradle-to-cradle certified. In certain aspects, the pad 236 is injection molded with the outer base 226. It should be understood that the refraction effect is possible regardless of whether the distance D' is variable or uniform.

The dispenser head 212 is configured to cause the fluid contained in the chamber 222 to be dispensed as a prelathered foam. In certain aspects, the dispenser head 212 includes an off-gassing nozzle 244 (see FIG. 19) including a water tight gasket (not shown). The off-gassing nozzle 244 is configured such that air may pass through, but fluid contained within the chamber 222 of the bottle 200 does not escape.

In operation, the dispenser head 212 is uncoupled from the bottleneck 230 to expose the opening 232. With fluid in the chamber 222 of the bottle 200, one or more effervescent tablets is inserted through the opening 232 of the bottleneck 230. The one or more effervescent tablets passes centrally through the fluid, with respect to the inner wall 214, towards the concave area 224 of the curved base 218. The one or more effervescent tablets settles at a substantially central portion of the curved base 218. The central positioning of the one or more effervescent tablets with respect to the curved base 218 and inner wall 214 allows the one or more effervescent tablets to dissolve efficiently and completely. The central positioning of the one or more effervescent tablets at the curved base 218 also allows the effervescence to evenly distribute along the inner wall 214 towards the bottleneck 230. Because both the inner wall 214 and the outer wall are clear, the effervescence is visible through the bottle 200. Additionally, the selective coloring of the pad 238 is specifically paired with the color of the fluid in the chamber 222 to create a refraction effect with the effervescence and the color of the fluid.

In an alternative implementation, the body 210 is formed of an upper portion and a lower portion such that the dispenser head 212 is permanently integrated to the upper portion. Further, the upper portion is removably couplable to the lower portion.

While some implementations have been illustrated and described, numerous modifications come to mind without significantly departing from the spirit of the disclosure, and the scope of protection is only limited by the scope of the accompanying claims. Terms such as "top," "bottom,"

"front," "rear," "upper," "lower," and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single product or packaged into multiple products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A bottle comprising:

an outer wall;

an inner wall surrounded by the outer wall, the inner wall being separated from the outer wall by a first distance;

a curved base extending from the inner wall, the curved base comprising a concave area centrally disposed with respect to the inner wall, the concave area being configured to receive a tablet; and a pad disposed at the curved base, wherein the pad comprises a refractive coloring selected to enhance a visibility of a foaming effervescence in the bottle through the curved base, the inner wall, and the outer wall.

2. The bottle of claim 1, wherein the first distance gradually increases as the inner wall is bent towards the curved base.

3. The bottle of claim 1, further comprising an outer base extending from the outer wall, wherein the outer base is separated from the curved base by a second distance.

4. The bottle of claim 3, wherein the second distance is greater than the first distance.

5. The bottle of claim 3, wherein the outer wall extends between an outer neck and the outer base, the inner wall extends between an inner neck and the curved base, and the outer neck and the inner neck form a bottleneck terminating at an opening.

6. The bottle of claim 5, wherein the concave area of the curved base is centrally aligned with the opening of the bottleneck.

7. The bottle of claim 5, further comprising one of a spray head and a dispenser head removably coupled to the bottleneck.

8. The bottle of claim 1, further comprising an upper portion including a spray head, the upper portion being removably coupled with a lower portion that includes the pad and the curved base.

9. The bottle of claim 1, wherein the inner wall and the outer wall are formed from clear acrylic.

10. The bottle of claim 1, wherein the bottle is manufactured with environmentally friendly certified materials.

11. A bottle comprising:

an outer wall extending between an outer neck and an outer base;

an inner wall surrounded by the outer wall, the inner wall being separated from the outer wall by a first distance;

a bottleneck formed of the outer neck and an inner neck extending from the inner wall, the bottleneck terminating at an opening;

a curved base extending from the inner wall, the curved base comprising a concave area centrally disposed with respect to the inner wall and centrally aligned with the opening of the bottleneck, the concave area being configured to receive a tablet, the curved base being separated from the outer base by a second distance, wherein the first distance gradually increases as the inner wall is bent towards the curved base such that the inner wall narrows transitionally towards the curved base; and a pad disposed at the curved base, wherein the pad comprises a refractive coloring selected to enhance a visibility of a foaming effervescence in the bottle through the curved base, the inner wall, and the outer wall.

12. The bottle of claim 11, wherein the second distance is greater than the first distance.

13. The bottle of claim 11, further comprising a pad disposed at the outer base, wherein the pad comprises a selective coloring refractable through the curved base, the inner wall, and the outer wall.

14. The bottle of claim 11, further comprising one of a spray head and a dispenser head removably coupled to the bottleneck.

15. The bottle of claim 11, wherein the bottle is formed from clear acrylic.

16. The bottle of claim 11, wherein the bottle is manufactured with environmentally friendly certified materials.

17. A bottle comprising:

an outer wall extending between an outer neck and an outer base;

an inner wall surround by the outer wall, the inner wall being separated from the outer wall by a first distance;

a bottleneck formed of the outer neck and an inner neck extending from the inner wall, the bottleneck terminating at an opening;

a spray head removably coupled to the bottleneck;

a curved base extending from the inner wall, the curved base comprising a concave area centrally disposed with respect to the inner wall and centrally aligned with the opening of the bottleneck, the concave area being configured to receive a tablet, the curved base being separated from the outer base by a second distance, wherein the first distance gradually increases as the inner wall is bent towards the curved base such that the inner wall narrows transitionally towards the curved base; and a pad disposed at the outer base, wherein the pad comprises a refractive coloring selected to enhance a visibility of a foaming effervescence in the bottle through the curved base, the inner wall, and the outer wall.

18. The bottle of claim 17, wherein the second distance is greater than the first distance.

19. The bottle of claim 17, wherein the bottle is formed from clear acrylic.

20. The bottle of claim 17, wherein the bottle is manufactured with environmentally friendly certified materials.

* * * * *